United States Patent [19]

Mollet et al.

[11] Patent Number: 4,518,392

[45] Date of Patent: May 21, 1985

[54] PROCESS FOR THE HT DYEING OF POLYESTER MATERIALS WITH ETHYLENE OXIDE PROPYLENE OXIDE BLOCK POLYMER

[75] Inventors: Hans Mollet, Reinach; Paul Dussy, Basel, both of Switzerland

[73] Assignee: Ciba Geigy Corporation, Ardsley, N.Y.

[21] Appl. No.: 512,093

[22] Filed: Jul. 8, 1983

[30] Foreign Application Priority Data

Jul. 15, 1982 [CH] Switzerland ..... 4305/82

[51] Int. Cl.[3] ..... C09B 67/00

[52] U.S. Cl. ..... 8/609; 8/475; 8/552; 8/934; 8/922

[58] Field of Search ..... 8/609, 475, 552

[56] References Cited

U.S. PATENT DOCUMENTS 3,892,522 7/1975 Schade et al. ..... 8/609

4,225,311 9/1980 Niimi et al. ..... 8/524

FOREIGN PATENT DOCUMENTS 1173119 12/1969 United Kingdom .

OTHER PUBLICATIONS

A. N. Derbyshire, J. Soc. Dyers and Colourists, 1972, 88, (II), pp. 389-392.

*Primary Examiner*—A. Lionel Clingman

*Attorney, Agent, or Firm*—Edward McC. Roberts; Kevin T. Mansfield

[57] ABSTRACT

The invention describes a process for the HT dyeing of polyester fibre material with dyes which are sparingly soluble in water, which process comprises the use of a dyebath which contains at least one block polymer of ethylene oxide and propylene oxide having a molecular weight higher than 5000.

The use of such a polymeric non-ionic dispersant ensures, even in low concentration, the stability of the dye dispersion under HT conditions, with at the same time substantial to complete bath exhaustion.

6 Claims, No Drawings

PROCESS FOR THE HT DYEING OF POLYESTER MATERIALS WITH ETHYLENE OXIDE PROPYLENE OXIDE BLOCK POLYMER

Initially, polyester materials were dyed very largely only by the carrier method. However, the drawbacks of this method were soon recognised, for example blotchy dyeings (carrier marks), poor fastness to light and rubbing, or also unpleasant odours during dyeing. But it was not until the machine industry made available closed apparatus for dyeing polyester fibres in the form of flocks, slubbing, yarn or piece goods that it was possible for the high temperature dyeing (HT dyeing for short) of polyester, which does not have the drawbacks referred to above, to gain general acceptance over carrier dyeing.

The HT process, in which the goods to be dyed and the dyebath are heated to temperatures of 125°–135° C. under pressure, results not only in dyeings of good fastness properties, but also requires only fairly short dyeing times. Despite all the advantages, however, HT dyeing is not entirely unproblematical. In particular, the stability of the dye dispersion in the HT range, i.e. at temperatures above 100° C., creates difficulties. For example, many disperse dyes tend to agglomerate or recrystallise at these temperatures and precipitate. Such agglomerates are troublesome, especially when dyeing packages, as the coarser dye particles deposit on the exterior of the packages, with filtration by the yarn, so giving rise to unlevel dyeings.

To increase the stability of the dyes under HT conditions, it is customary to add large amounts of anionic dispersant to the dyebath, or to use dye formulations which contain a high concentration of dispersant. The concentration of dispersant is up to 80%, based on the formulation. Such high concentrations of dispersant not only severly pollute the wastewater, but have a deleterious effect on the degree of exhaustion, with the consequence that substantial amounts of dye remain in the dyebath. Besides loss of valuable dye, this also leads to pollution of the wastewater.

Surprisingly, it has now been found that specific non-ionic auxiliaries, viz. block polymers of ethylene oxide and propylene oxide having a molecular weight higher than 5000, ensure the stability of disperse dyes in the HT range and, in addition, are extremely effective even when employed in low concentration. This effect is unexpected, as it is expressly stated in the literature [see A. N. Derbyshire et al., JSDC 88, 389 (1972)] that the addition of non-ionic auxiliaries of the non-carrier type impairs the stability of dye dispersions.

Accordingly, the present invention relates to a process for the HT dyeing of polyester fibre material with dyes which are sparingly soluble in water, which process comprises the use of a dyebath which contains at least one block polymer of ethylene oxide and propylene oxide having a molecular weight higher than 5000.

Preferred block polymers of ethylene oxide and propylene employed in the practice of this invention are those having a molecular weight of 5000 to 20,000 and having the formula $$HO(CH_2CH_2O)_a(CH(CH_3)CH_2O)_b(CH_2CH_2O)_c-H$$

wherein each of the indices a, b and c is an integer greater than 1, the sum of a+b+c is in the range from 200 to 400, and (a+c)/b is 3 to 9.

Block polymers of ethylene oxide and propylene oxide which have a particularly beneficial effect on the stability of the dispersion are those having a molecular weight of 15,000 to 17,000 at a ratio of (a+c):b of 4 to 6.

It is preferred to add the non-ionic dispersant to the dyebath in a concentration of 5 to 20% by weight; but a concentration of 10% by weight, based on the dye, suffices in most cases.

The dyeing temperature of the process of this invention is in the range from 120° to 140° C. The goods to be dyed are kept in the dyebath for about 1 hour at this temperature. The dyebath is then cooled, and the dyed material is removed from the dyeing apparatus and finished by conventional methods.

The dyes which are sparingly soluble in water employed in the process of the invention are, in particular, disperse dyes which may belong to the following chemical classes: nitro dyes, aminoketone dyes, ketone-imine dyes, methine dyes, nitrodiphenylamine dyes, quinoline dyes, aminonaphthoquinone dyes, coumarin dyes and, in particular, anthraquinone dyes and azo dyes such as monoazo and disazo dyes. The dyes are employed in finely dispersed form (primary particle size: $<5$ μm); but they may also have a particle size of up to 20 μm.

The block polymer of ethylene oxide and propylene oxide is conveniently added to the dyebath in the form of an appropriately formulated dye composition which already contains the block polymer as dispersant. Such formulations comprise e.g.: 10 to 40% by weight of dye, 2 to 6% by weight of block polymer of ethylene oxide and propylene oxide, at least 10% by weight of water and optionally further ingredients, e.g. humectants such as N,N-bis(dihydroxypropyl)butylamine, antifreeze agents, e.g. polyols, ethylene glycol, sorbitol and the like, or formamide; microbicides, fungicides, e.g. aqueous formalin solution; antifoams and viscosity improvers.

Instead of using aqueous liquid formulations, it is also possible to use solid dye formulations obtained e.g. by spray drying in the dyeing process of this invention.

In addition to dye and block polymer or dye formulation containing the auxiliaries, further ingredients may added to the dyebath, e.g. inorganic salts such as ammonium sulfate, or also small amounts of anionic dispersants such as lignosulfonate or condensates of formaldehyde and naphthalenesulfonic acids. It is also convenient to adjust the pH of the dyebath to a value from 4 to 6, e.g. by adding formic acid.

The polyester fibre material dyeable by the process of this invention consists of polyesters, preferably of polyethylene glycol terephthalate, and may be in different forms of processing, e.g. knits, wovens, yarns and filaments, as well as finished articles such as shirts or ties.

Suitable machines for dyeing polyester flocks and carded slivers are HT circulation dyeing machines with packing cage. Smooth yarns can also be dyed in HT circulation dyeing machines on cheeses, and texturised yarns in the form of packages. Wovens and knitted fabrics are dyed in HT winch becks, HT jet dyeing machines or HT beam dyeing machines.

It will be readily appreciated that dyeing by the process of this invention can also be carried out under normal pressure, i.e. up to a temperature of 100° C., with one of the conventional carriers, e.g. o-phenylphenol, being added to the dyebath besides the dye and the block polymer of the indicated formula.

The most significant advantages of the process of this invention may be summarised as follows:

(a) the block polymer of ethylene oxide and propylene oxide employed as dispersant ensures the stability of the dye dispersant in the dyebath under HT conditions, i.e. no filtration of dye particles by the fibre material occurs;

(b) the degree of bath exhaustion is substantial to complete;

(c) only a small concentration of block polymer is required and wastewater pollution is therefore of an extremely low order.

The invention is illustrated by the following Examples in which parts and percentages are by weight, unless otherwise stated.

EXAMPLE 1

200 Parts of water are put into a pressure dyeing apparatus and then 2 parts of a dye formulation are dispersed therein. 100 g of this dye formulation contain 17 g of the dye of the formula

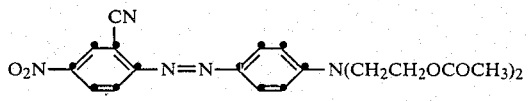

(particle size $<2$ μm), 3 g of a block polymer of ethylene oxide and propylene oxide of the formula indicated in the description and having a molecular weight of about 16,500 and a ratio of (a+c):b of about 5, and 80 g of water. To the dyebath is further added 0.4 part of ammonium sulfate and the pH is adjusted to 4.5–5.5 with formic acid.

The bath is heated to 60° C., then 10 parts of polyethylene terephthalate fabric are put into it and the bath is subsequently further heated to 130° C. with good filter circulation. Dyeing is continued for 1 hour at 130° C., then the bath is cooled to 90° C. and the goods are rinsed first with warm and then with cold water. The dyebath is almost completely exhausted and a level deep red dyeing of excellent fastness properties is obtained.

An equally good dyeing, again with almost complete bath exhaustion, is obtained by substituting for the above non-ionic block polymer the same amount of a block polymer of ethylene oxide and propylene oxide having a molecular weight of about 13,500 and a ratio of (a+c):b of about 3, or having a molecular weight of about 8,500 and a ratio of (a+c):b of about 9.

EXAMPLE 2

Polyethylene terephthalate fabric is dyed in a HT dyeing machine as described in Example 1, except that 2 parts of the dye formulation used therein are replaced by 3 parts of a formulation containing, per 100 g, 25.4 g of a dye mixture consisting of two dyes of the following constitution (particle size: $<2$ μm)

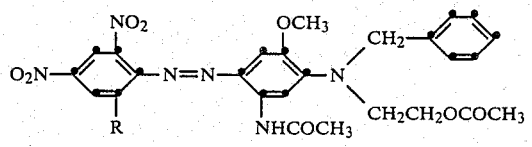

wherein R in one case is hydrogen and in the other chlorine (ratio 1:3), 3 g of the block polymer of Example 1 (mol.wt. about 16,500; (a+c):b ~ 5) and 71.6 g of water.

At the conclusion of dyeing, the dyebath is in this case too almost completely exhausted. A deep, level navy-blue dyeing of very good fastness properties is obtained.

EXAMPLE 3

Polyethylene terephthalate fabric is dyed in a HT dyeing machine as described in Example 1, except that 2 parts of the dye formulation employed therein are replaced by 2 parts of a formulation which contains, per 100 g, 38.6 g of a dye of the formula

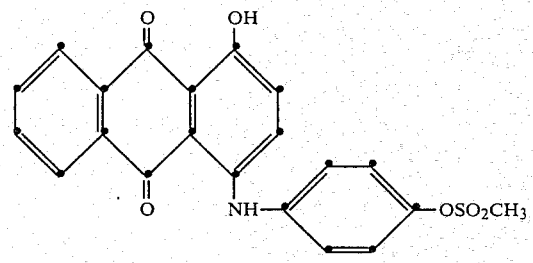

(average particle size: 0.2 to 0.5 μm), 3 g of the block polymer employed in Example 1 (mol. wt. about 16,500; (a+c):b ~ 5) and 58.4 g of water, although some of the water may be replaced by a humectant of the formula

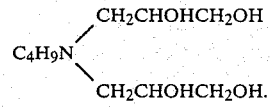

An almost completely exhausted bath remains at the conclusion of dyeing and after removal of the dyed goods. A deep, level violet dyeing also of very good fastness properties is obtained.

If dyestuff formulations which contain 30 to 60 g of an anionic dispersant (based on 100 g of formulation), e.g. a lignosulfonate or condensate of formaldehyde/-naphthalenesulfonic acid, are used in the dyeing process described in the foregoing Examples instead of a block polymer, then no comparably good bath exhaustion is achieved and substantial amounts of dye still remain in the dyebath.

What is claimed is:

1. A process for the HT dyeing of polyester fibre material with dyes which are sparingly soluble in water, which process comprises the use of a dyebath which contains at least one block polymer of ethylene oxide and propylene oxide having a molecular weight higher than 5000.

2. A process according to claim 1, which comprises the use of a block polymer of ethylene oxide and propylene oxide having a molecular weight of 5000 to 20,000 and having the formula

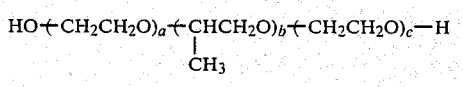

wherein each of a, b and c is an integer greater than 1, the sum of a+b+c is in the range from 200 to 400, and (a+c)/b is 3 to 9.

3. A process according to claim 2, which comprises the use of a block polymer of ethylene oxide and propylene oxide having a molecular weight of 15,000 to 17,000, wherein (a+c)/b is 4 to 6.

4. A process according to claim 1, which comprises the use of a block polymer of ethylene oxide and propylene oxide in a concentration of 5 to 20% by weight, based on the amount of dye.

5. A process according to claim 1, wherein the block polymer of ethylene oxide and propylene oxide is put into the dyebath in the form of an appropriately formulated dye formulation.

6. Polyester fibre material dyed by the process as claimed in claim 1.

* * * * *